US009044059B2

(12) United States Patent
Briant

(10) Patent No.: US 9,044,059 B2
(45) Date of Patent: Jun. 2, 2015

(54) VERSATILE, INTEGRATED GAITER

(75) Inventor: Antoine Briant, Montebelluna (IT)

(73) Assignee: THE NORTH FACE APPAREL CORP., Wilmington, DE (US)

( * ) Notice: Subject to any disclaimer, the term of this patent is extended or adjusted under 35 U.S.C. 154(b) by 813 days.

(21) Appl. No.: 13/205,732

(22) Filed: Aug. 9, 2011

(65) Prior Publication Data

US 2013/0036626 A1 Feb. 14, 2013

(51) Int. Cl.

| | |
|---|---|
| ***A43B 3/24*** | (2006.01) |
| ***A43B 1/00*** | (2006.01) |
| ***A43B 3/02*** | (2006.01) |
| ***A43B 23/06*** | (2006.01) |
| ***A43B 7/20*** | (2006.01) |
| ***A43C 11/14*** | (2006.01) |

(52) U.S. Cl.

CPC ..... *A43B 1/0081* (2013.01); *A43B 3/242* (2013.01); *A43B 3/02* (2013.01); *A43B 23/06* (2013.01); *A43B 7/20* (2013.01); *A43C 11/1493* (2013.01)

(58) Field of Classification Search

CPC ..... A43B 3/242; A43B 3/02; A43B 23/06; A43B 3/06; A43B 3/24

USPC ..... 36/100, 2 R, 50.1, 1.5

See application file for complete search history.

(56) References Cited

U.S. PATENT DOCUMENTS

| | | | | |
|---|---|---|---|---|
| 296,495 | A | 4/1884 | Williamson | |
| 984,608 | A | 2/1911 | Roberts | |
| 1,476,826 | A * | 12/1923 | Martin | 36/45 |
| 1,626,587 | A * | 4/1927 | Thomas | 36/50.1 |
| 1,851,629 | A * | 3/1932 | Herzstein | 36/45 |
| 2,526,663 | A * | 10/1950 | Holland | 2/239 |
| 3,618,232 | A | 11/1971 | Shnuriwsky | |
| 3,807,062 | A * | 4/1974 | Spier | 36/117.2 |
| 4,856,207 | A | 8/1989 | Datson | |
| 5,642,573 | A | 7/1997 | Brown | |
| 5,784,806 | A | 7/1998 | Wendt | |
| 6,148,544 | A | 11/2000 | Keen et al. | |
| 6,785,983 | B2 | 9/2004 | Challe | |
| D564,187 | S | 3/2008 | Webb | |
| 7,726,045 | B2 | 6/2010 | Riebesell | |
| 7,937,852 | B1 | 5/2011 | Krehbiel | |
| D643,611 | S * | 8/2011 | Ringholz | D2/970 |
| 2006/0185192 | A1 * | 8/2006 | Biancucci | 36/45 |

OTHER PUBLICATIONS

International Search Report of PCT/US2012/049967 issued Nov. 2, 2012 & Written Opinion.

* cited by examiner

*Primary Examiner* — Ted Kavanaugh
(74) *Attorney, Agent, or Firm* — Kenyon & Kenyon LLP

(57) ABSTRACT

An article of footwear includes a tongue, a collar located at an upper portion of the footwear, and a gaiter having a lower portion integrally fixed to the collar of the footwear. The tongue and the collar together define an opening, preferably sized to receive a wearer's foot. The gaiter includes first and second fastening flaps and a fastening device (or fastening means) located on the first and second fastening flaps. The gaiter is configured to switch between high and low positions, the high position being a position in which a substantial portion of the gaiter extends above the upper-most portion of the footwear, and the low position being a position in which a substantial portion of the gaiter is located below the upper-most portion of the footwear.

4 Claims, 4 Drawing Sheets

VERSATILE, INTEGRATED GAITER

TECHNICAL FIELD

The present invention generally relates to protective gaiters integrated with footwear.

BACKGROUND

Protective gaiters are commonly used in conjunction with boots in order to prevent water, snow, small stones, or other debris from falling into the boot. Because these gaiters tend to increase the heat retained around the ankles and lower leg, they may often cause discomfort to the wearer when the protection of the gaiter is not necessary, particularly in warmer areas or during strenuous activity. Therefore, conventional protective gaiters are typically separate from the footwear to allow the wearer to detach the gaiter and cool the ankles and lower legs when the gaiter is not needed.

There are drawbacks to these products, however. In particular, they require a substantial amount of time to attach and detach, which causes inconvenience if a user quickly moves between areas that do and do not require protection. Some gaiters even require that a wearer remove his or her footwear entirely in order to detach the gaiters.

Although gaiters that are fixedly attached to boots have been proposed, they have drawbacks of their own. Specifically, they do not allow a user to remove them in warmer areas. Thus, a wearer cannot become more comfortable or cool his or her ankles and lower leg without completely removing the boot.

Accordingly, there is a need for a gaiter that allows for easy switching between protected and unprotected positions.

SUMMARY

The present invention generally relates to protective gaiters integrally fixed to footwear, such as boots, shoes, and the like. The gaiter is configured to switch easily between a high, protected position and a low, unprotected position. In the high position, at least a portion of a wearer's ankle is protected by the gaiter. Also in this position, the gaiter prevents rocks, dirt, snow, and other debris from falling into the footwear. In the low position, the gaiter is flipped over an upper portion of the footwear to expose a wearer's ankle. Although unprotected, the low position offers the advantage of cooling a wearer's ankle and lower leg during warm weather or strenuous physical activity.

In one embodiment of the present invention, an article of footwear includes a tongue, a collar located at an upper portion of the footwear, and a gaiter having a lower portion integrally fixed to the collar of the footwear. The tongue and the collar together define an opening, preferably sized to receive a wearer's foot. The gaiter includes first and second fastening flaps and a fastening device located on the first and second fastening flaps. The gaiter is configured to switch from a high position to a low position, the high position being a position in which a substantial portion of the gaiter extends above the upper-most portion of the footwear, and the low position being a position in which a substantial portion of the gaiter is located below the upper-most portion of the footwear.

In another embodiment of the present invention, an article of footwear includes a tongue, a collar located at the upper portion of the footwear, and a gaiter having a lower portion integrally fixed to the collar of the footwear. The tongue and the collar together define an opening, preferably sized to receive a wearer's foot. The gaiter includes first and second fastening flaps and means for fastening the first and second fastening flaps together, located on the first and second fastening flaps. The gaiter is configured to switch from a high position to a low position, the high position being a position in which a substantial portion of the gaiter extends above the upper-most portion of the footwear, and the low position being a position in which a substantial portion of the gaiter is located below the upper-most portion of the footwear.

The present invention also provides a method of switching a gaiter between high and low positions.

In one particular embodiment, a method of switching a gaiter from a high position to a low position includes the following steps: providing footwear having a gaiter integrally fixed thereto, wherein the gaiter includes first and second fastening flaps and a fastening device located on the first and second fastening flaps; opening the fastening flaps of the gaiter by disengaging the fastening device; flipping the gaiter from a high position to a low position; and closing the fastening flaps of the gaiter by engaging the fastening device. The high position being a position in which a substantial portion of the gaiter extends above the upper-most portion of the footwear, and the low position being a position in which a substantial portion of the gaiter is located below the upper-most portion of the footwear.

The present invention also provides a method of switching a gaiter from a low position to a high position. In one particular embodiment, a method of switching a gaiter from a low position to a high position includes the following steps: providing footwear having a gaiter integrally fixed thereto, wherein the gaiter includes first and second fastening flaps and a fastening device located on the first and second fastening flaps; opening the fastening flaps of the gaiter by disengaging the fastening device; flipping the gaiter from a low position to a high position; and closing the fastening flaps of the gaiter by engaging the fastening device. The low position being a position in which a substantial portion of the gaiter is located below the upper-most portion of the footwear, and the high position being a position in which a substantial portion of the gaiter extends above the upper-most portion of the footwear.

The invention may be embodied in numerous devices and through numerous methods and systems. The following detailed description, taken in conjunction with the annexed drawings, discloses examples of the invention. Other embodiments, which incorporate some, all, or more of the features as taught herein, are also possible.

BRIEF DESCRIPTION OF THE DRAWINGS

The present invention will become more fully understood from the detailed description given within and its accompanying drawings. These drawings are given by way of illustration only and are not limitative of the present invention. The drawings provided with this application are as follows.

DETAILED DESCRIPTION

The present invention generally relates to protective gaiters integrated with footwear. A broad range of footwear is suitable for use in the present invention. Non-limiting examples of suitable footwear include shoes (such as sneakers), boots of various sizes, and similar footgear. The footwear may include any of the components typically found thereon, such as laces, lacing guides, tongues, cushioned soles, reflective surfaces, cleats, and the like.

A gaiter in accordance with preferred embodiments of the present invention is configured to switch easily between a high, protected position and a low, unprotected position. In the high position, at least a portion of a wearer's ankle is protected by the gaiter. Also in this position, the gaiter prevents rocks, dirt, snow, and other debris from falling into the footwear. In the low position, the gaiter is flipped over an upper portion of the footwear to expose a wearer's ankle. Although unprotected, the low position offers the advantage of cooling a wearer's ankle or lower leg during warm weather or strenuous physical activity. Because the wearer need not attach and detach the gaiter, the wearer may switch between high and low positions quickly and with relative ease.

Figure 1A:
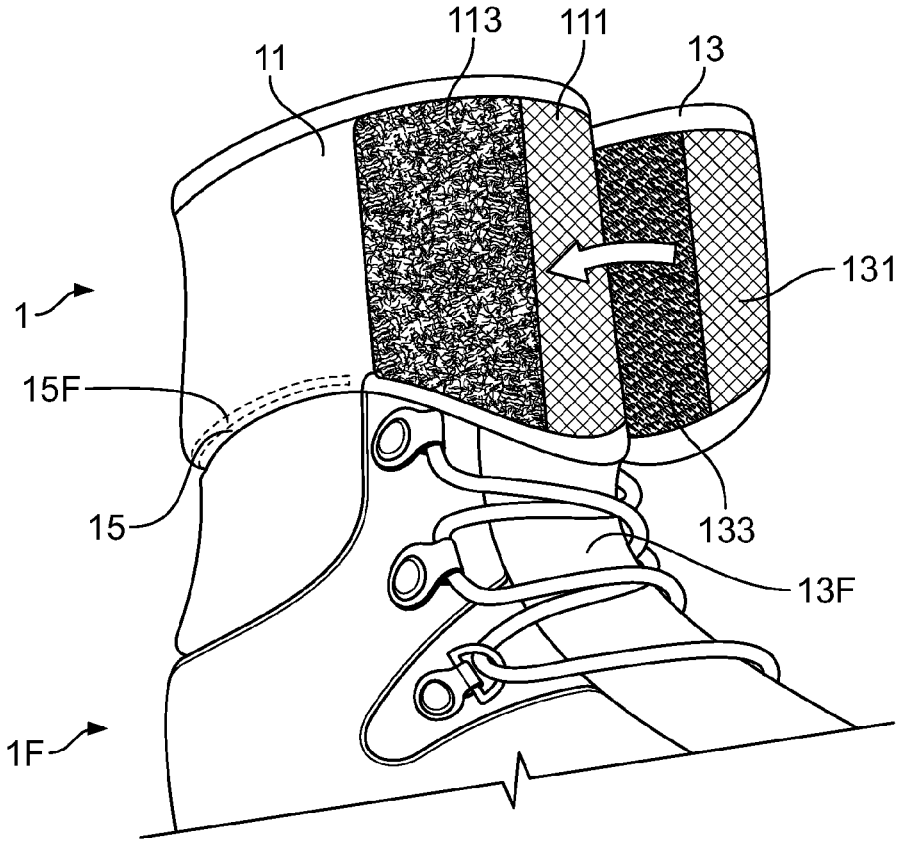
FIG. 1A shows a perspective view of an article of footwear having an integrated gaiter in a high position, in accordance with certain embodiments of the present invention.
Figure 1B:
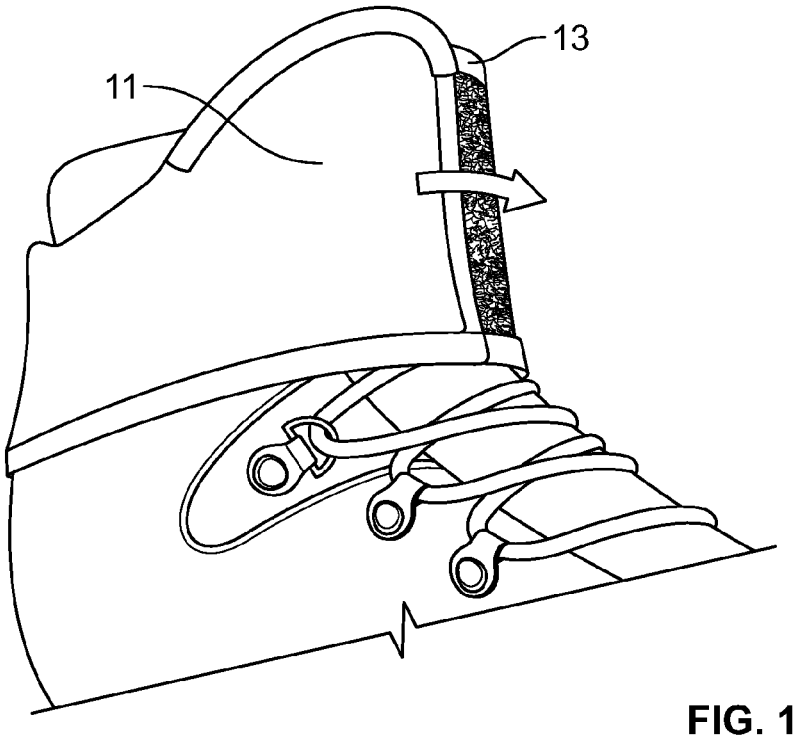
FIG. 1B shows a perspective view of the footwear of FIG. 1A, showing the integrated gaiter in a low position.

One particular example of an article of footwear in accordance with the present invention is shown in FIGS. 1A and 1B. Footwear 1F includes a gaiter 1, a tongue 13F, and a collar 15F. Tongue 13F and collar 15F together define an opening in footwear 1F, preferably sized and shaped to receive a wearer's foot. Gaiter 1 attaches to a collar 15F of footwear 1F by a lower portion 15 of gaiter 1.

In this embodiment, gaiter 1 is integrally fixed to footwear 1F. By "integrally fixed" it is meant that the gaiter is non-removably connected to the footwear. That is, the gaiter may be permanently attached to the footwear, by means of stitching, sewing, gluing, stapling, sonic welding, or any other known method for joining fabrics or similar materials together. Lower portion 15 of gaiter 1 is affixed to collar 15F of footwear 1F. Preferably, gaiter 1 is attached around substantially the entire circumference of collar 15F. However, gaiter 1 may also be attached around only a portion of the collar. In addition, gaiter 1 is preferably not attached to (that is, separate from) tongue 13F of footwear 1F.

A gaiter in accordance with the present invention is preferably configured to switch from a high position to a low position by flipping the gaiter. The high position may be a position in which a substantial portion of the gaiter extends above the upper-most portion of the footwear, as shown in FIG. 1A. The low position may be a position in which a substantial portion of the gaiter is located below the upper-most portion of the footwear, as shown in FIG. 1B. Preferably, in the high position, substantially all of the gaiter is disposed above the collar or upper-most surface of the footwear, as shown in FIG. 1A. Similarly, in preferred embodiments, nearly all of the gaiter is disposed below the upper-most surface or collar of the footwear in the low position. More preferably, in the low position, the gaiter wraps around a portion of the footwear's upper.

A gaiter in accordance with the present invention is preferably made from a material that allows the gaiter to switch from the high (protected) position to the low (unprotected) position quickly and easily, preferably by flipping rather than by rolling or bunching. Accordingly, a gaiter in accordance with preferred embodiments of the present invention is made of a stretchable material that allows it to easily "flip" between its high and low positions, as shown in FIGS. 2A-2D. More preferably, the material has a four-way stretch and good abrasion characteristics. Non-limiting examples of suitable materials for the gaiter include spandex and poly-nylon blends.

Gaiter 1 includes a first fastening flap 11 and a second fastening flap 13. These flaps may include (or, alternatively, may define) a fastening device. The fastening device may be any component suitable for fastening objects together. Non-limiting examples of the fastening device include zippers, buttons, snaps, hook and loop fasteners (such as VELCRO®), and buckles. Preferably, laces are not used as part of the fastening device, as these would tend to inhibit the gaiter's ability to "flip" between high and low positions. The fastening flaps may be made of any material suitable for constructing the gaiter.

Referring to FIG. 1A, gaiter 1 is shown with a fastening device having hooks 111 and loops 113 on the outer surface of first flap 11, and hooks 131 and loops 133 on the inner surface of second flap 13. Each flap need not have both hooks and loops, however. In the case of a different fastening device, such as buttons, one flap may have one or more "male" connectors and the other flap one or more corresponding "female" connectors configured to engage with the male connectors. The fastening device is configured to secure (that is, to fasten) flaps 11 and 13 to one another in both the high (FIG. 1A) and low (FIG. 1B) positions.

Instead of a fastening device, means for fastening the first and second fastening flaps together may be provided. The fastening means may be any component suitable for fastening objects together. Non-limiting examples of the fastening means include zippers, buttons, snaps, hook and loop fasteners (such as VELCRO®), and buckles. The fastening means may have a configuration similar to the fastening device described previously.

Figure 2A:
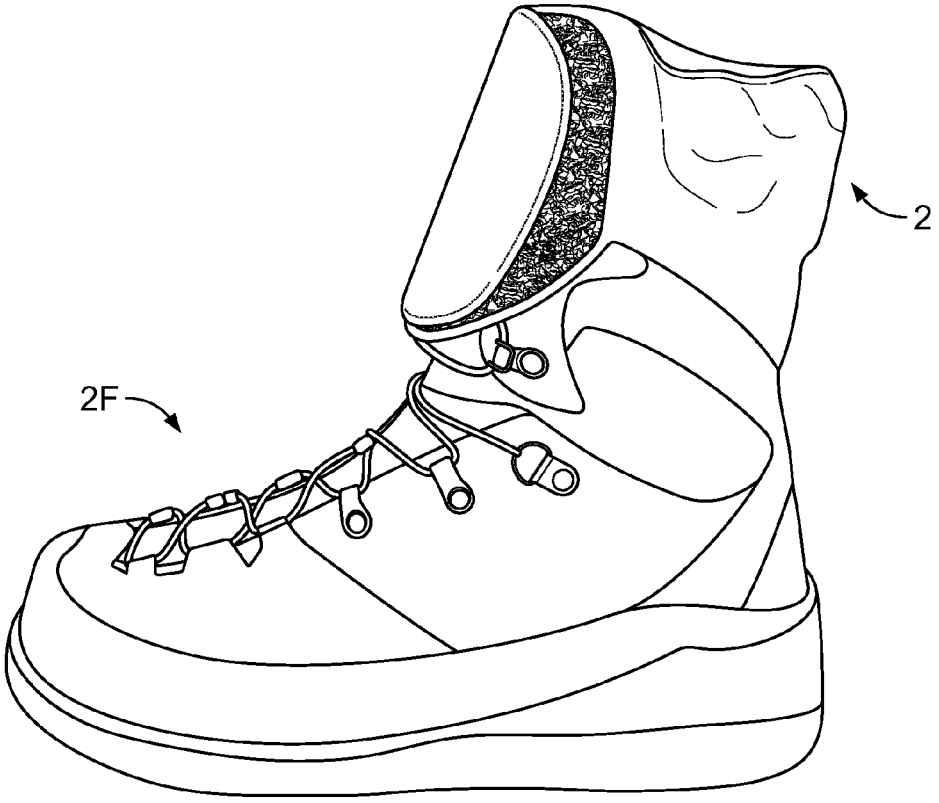
FIG. 2A shows a side view of an article of footwear in a high position with fastening flaps closed, in accordance with certain other embodiments of the present invention.
Figure 2B:
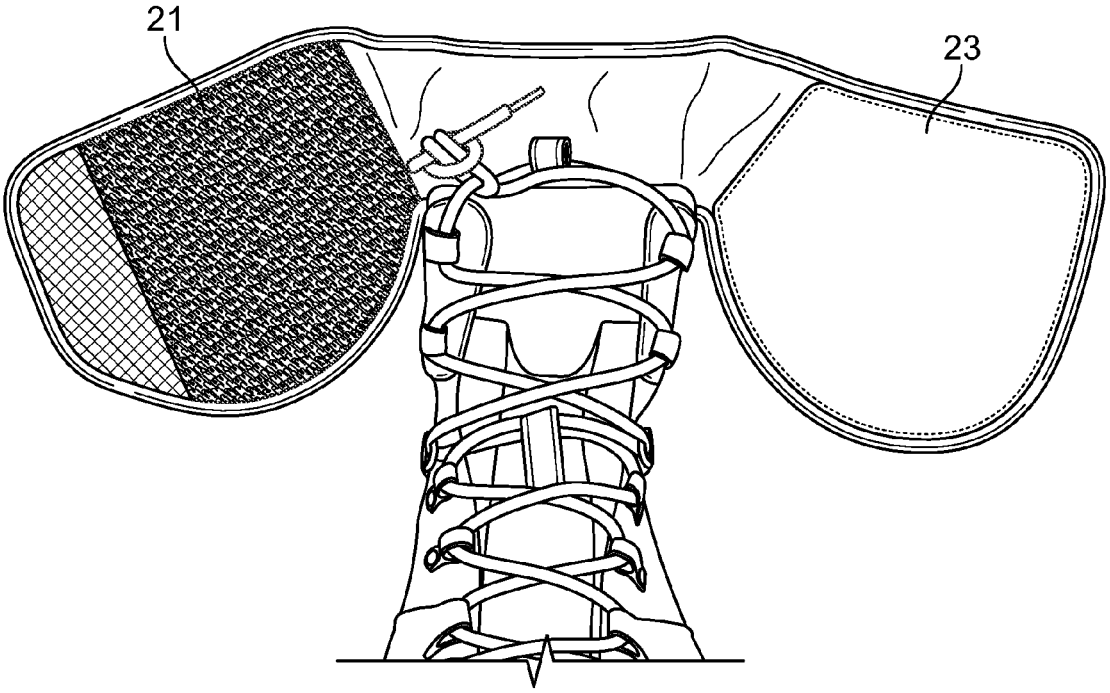
FIG. 2B shows a front view of the footwear of FIG. 2A in the high position with fastening flaps open.
Figure 2C:
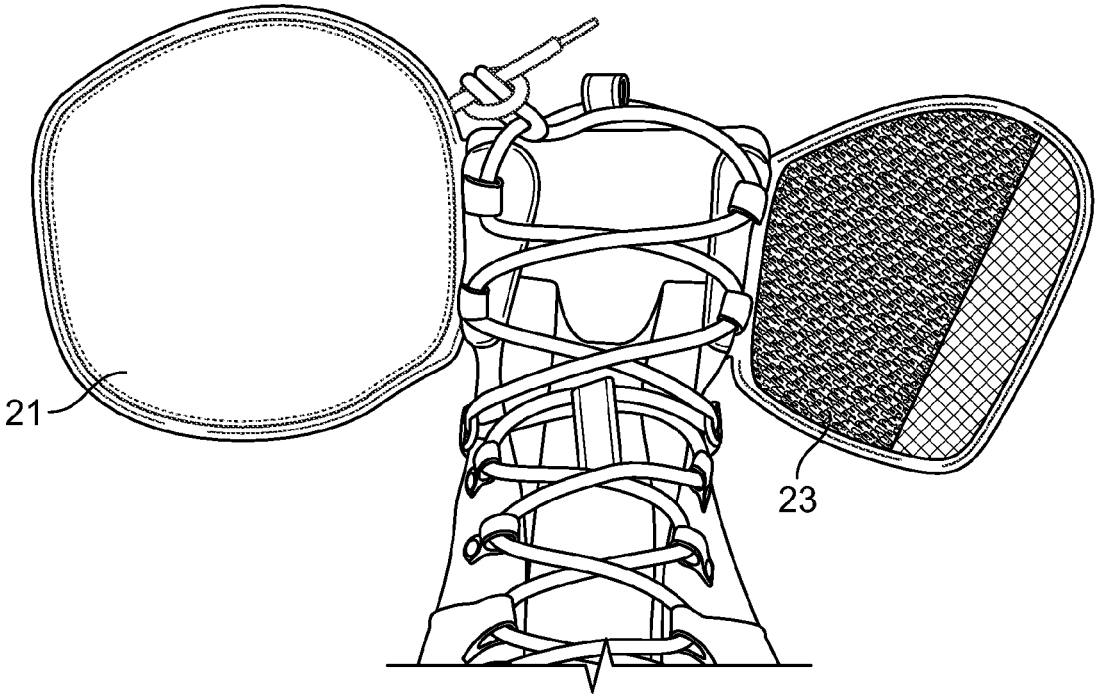
FIG. 2C shows a front view of the footwear of FIG. 2A in a low position with fastening flaps open.
Figure 2D:
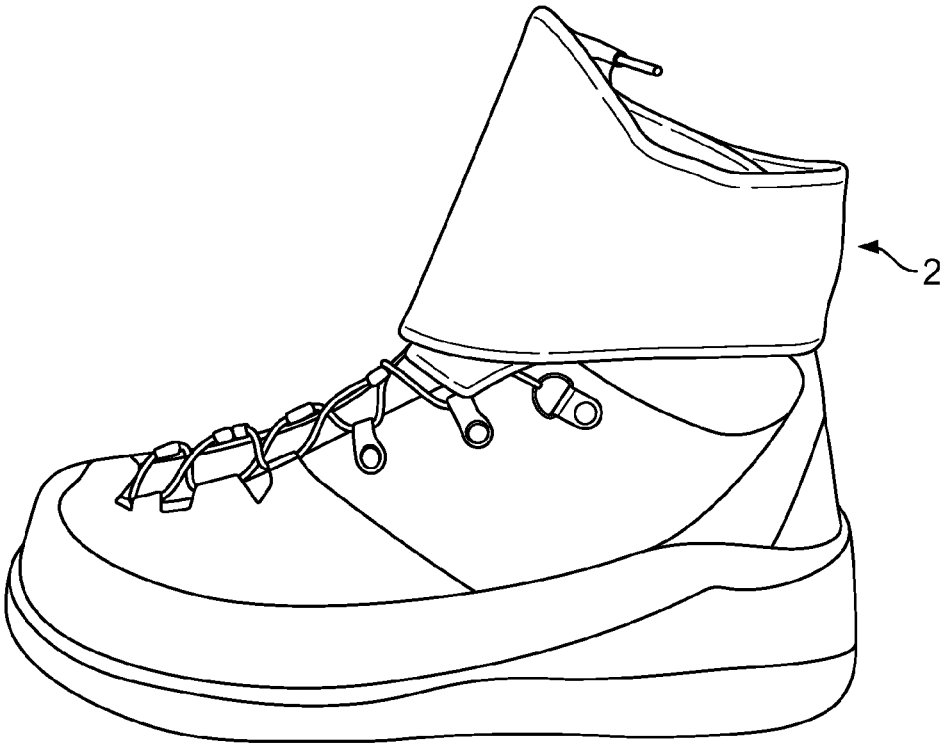
FIG. 2D shows a side view of the footwear of FIG. 2A in a low position with fastening flaps closed.

Preferably, the fastening device (or fastening means) is configured to secure the first and second flaps together in both a high, protected position and a low, unprotected position. As shown in FIGS. 2A and 2D, the fastening device secures flaps 21 and 23 in a closed configuration in both the protected/high (FIG. 2A) and unprotected/low (FIG. 2D) positions. In FIGS. 2A-2D, the fastening device includes hook and loop fasteners. Other fastening devices, such as buttons or zippers, may also be used in this way.

In order to achieve the goal of fastening the flaps in both the high and low positions of the gaiter, the fastening device (or fastening means) may be located on either or both sides of either or both fastening flaps. In one particular example, shown in FIGS. 2A-2D, flap 21 includes loops on the front-facing surface shown in FIG. 2B, while the front-facing surface in FIG. 2C does not include a fastening component. Similarly, front-facing surface of flap 23 in FIG. 2C includes hooks, while the front-facing surface in FIG. 2B does not include a fastening component. The non-component containing surfaces of the flaps may be used to display a design, company logo, brand name, or other graphic. Alternatively, each side of each flap may include one or more fastening components.

Figure 3:
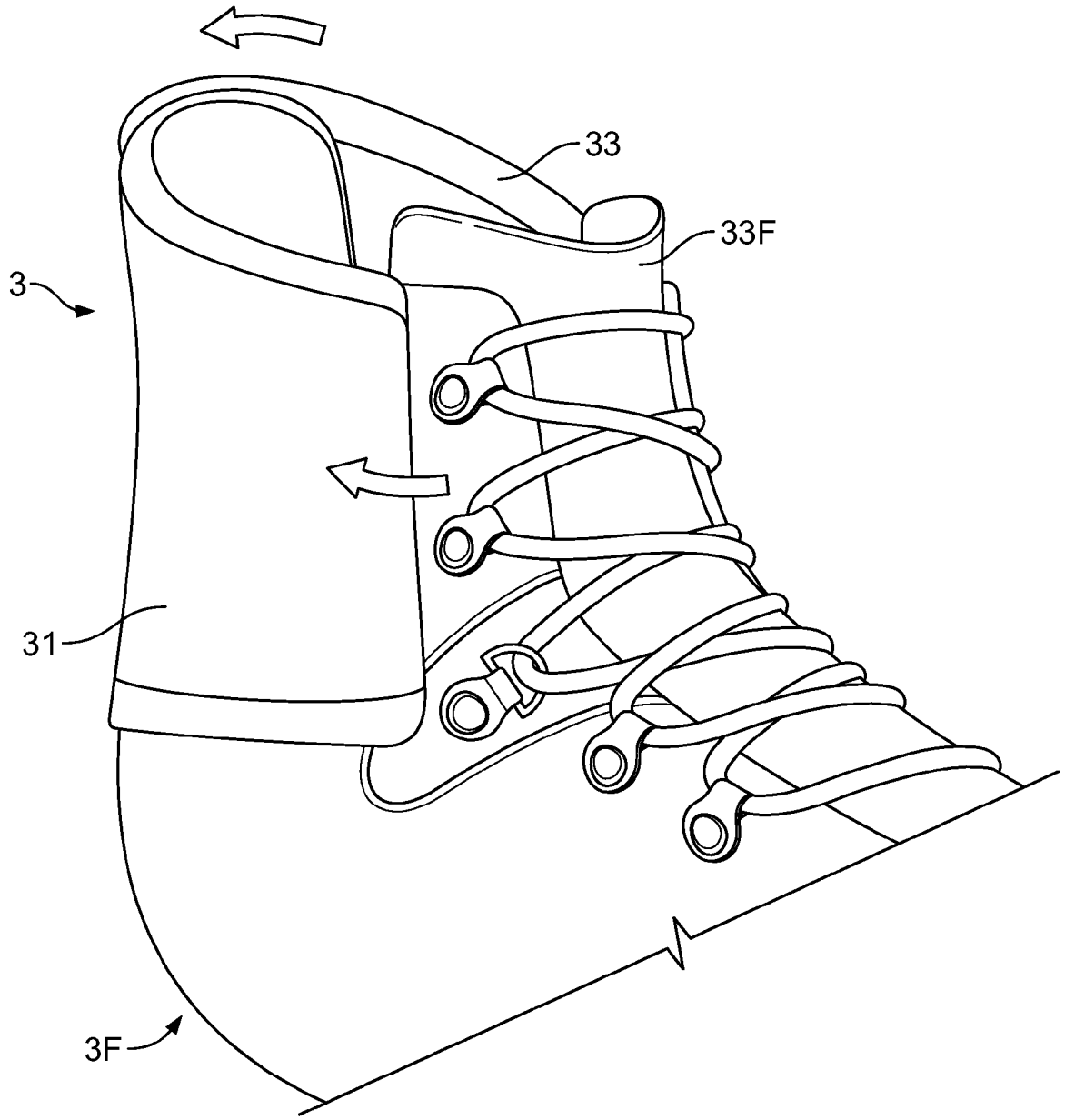
FIG. 3 shows a perspective view of an article of footwear having an integrated gaiter in a low position with fastening flaps closed, in accordance with yet another embodiment of the present invention.

The fastening flaps need not attach to one another on the front portion of the footwear, as shown in FIGS. 2A-2D, in all embodiments. In an alternative embodiment, shown in FIG. 3, fastening flaps 31 and 33 may alternatively fasten in the back portion of footwear 3F. This exposes tongue 33F when flaps 31 and 33 are attached to one another in the low position, thereby providing enhanced cooling to the wearer. The fastening device (or fastening means) included in this embodiment would be suitably configured to attach behind the footwear. That is, the arrangement of the fastening device (such as hook and loop fasteners) would be located on appropriate surfaces of each fastening flap, so as to ensure proper closure in the back of the footwear when in the low position.

The present invention also provides a method of switching a gaiter between high and low positions.

In one particular embodiment, this method includes the steps of providing footwear having a gaiter integrally fixed thereto and switching the gaiter from a high position to a low position. In this embodiment, the high position is a position in which a substantial portion of the gaiter extends above the upper-most portion of the footwear, and the low position is a position in which a substantial portion of the gaiter is located below the upper-most portion of the footwear.

In another embodiment, a method of switching a gaiter from a high position to a low position includes the following steps: providing footwear having a gaiter integrally fixed thereto, wherein the gaiter includes first and second fastening flaps and a fastening device located on the first and second fastening flaps; opening the fastening flaps of the gaiter by disengaging the fastening device; flipping the gaiter from a high position to a low position; and closing the fastening flaps of the gaiter by engaging the fastening device. The high position being a position in which a substantial portion of the gaiter extends above the upper-most portion of the footwear, and the low position being a position in which a substantial portion of the gaiter is located below the upper-most portion of the footwear.

By "engaging" the fastening device, it is meant that the first fastening flap is secured (that is, fastened) to the second fastening flap so as to close the gaiter. Similarly, by "disengaging" the fastening device, it is meant that the first fastening flap is detached from the second fastening flap so as to open the gaiter.

More specifically, a wearer of footwear in accordance with certain embodiments of the present invention would switch from a high position to a low position as follows. Beginning with the gaiter in the high position with the fastening flaps secured to one another (shown in FIG. 2A), the wearer opens (that is, detaches) the fastening flaps as shown in FIG. 2B by disengaging the fastening device. Then, a wearer flips the gaiter down around a portion of the upper portion of the footwear, as shown in FIG. 2C. Preferably, this action occurs without substantial deformation or bunching up of the gaiter. That is, rather than being rolled down—as with a sock or the sleeves of a shirt—the gaiter maintains its shape but simply flips or inverts itself around a pivot point—such as the footwear's collar—to arrive in the low position. Once the gaiter is flipped to the low position (shown in FIG. 2C), the wearer once again closes (that is, secures) the fastening flaps, as shown in FIG. 2D, by engaging the fastening device. Switching back to the high position from the low position would simply entail performing the preceding steps in reverse.

While various embodiments have been described, other embodiments are plausible. The foregoing descriptions of various examples of a protective gaiter integrated with footwear are not limiting. Any number of modifications, combinations, and alternatives of these examples may be employed to facilitate the effectiveness of allowing a user to switch easily between protected (high) and non-protected (low) positions of an integrated gaiter.

Numerous other embodiments may be implemented without departing from the spirit and scope of these exemplary embodiments of the present invention. Moreover, while certain features of the invention may be shown on only certain embodiments, these features may be exchanged, added, and removed from and between the various embodiments. Likewise, methods described may also be performed in various sequences, with some or all of the disclosed steps being performed in a different order than described while still remaining within the spirit and scope of the present invention.

I claim:

1. An article of footwear, comprising:

a tongue;

a collar located at an upper portion of the footwear, wherein the tongue and the collar together define an opening; and a gaiter having a lower portion integrally fixed to the collar of the footwear, wherein the gaiter includes first and second fastening flaps and a fastening device located on front faces of the first and second fastening flaps, wherein the gaiter is configured to switch from a high position to a low position, the high position being a position in which a substantial portion of the gaiter extends above the upper-most portion of the footwear, and the low position being a position in which a substantial portion of the gaiter is located below the upper-most portion of the footwear, wherein the gaiter is stitched to the footwear along the collar, wherein the fastening device is a hook and loop fastener system including hooks on one of the front facing surfaces of the first and second fastening flaps, and loops on one of the other front facing surfaces of the first and second fastening flaps, wherein the fastening device is configured to secure the first fastening flap to the second fastening flap in both the high and low positions of the gaiter, and wherein the fastening device is configured to secure the first fastening flap to the second fastening flap in a front portion of the footwear in both the high and low positions of the gaiter.

2. The footwear of claim 1, wherein the gaiter is not stitched to the tongue of the footwear.

3. The footwear of claim 1, wherein the footwear is a boot.

4. The footwear of claim 1, wherein the gaiter is made from spandex.

* * * * *